US010631613B1

(12) United States Patent
Totonelly

(10) Patent No.: US 10,631,613 B1
(45) Date of Patent: Apr. 28, 2020

(54) APPARATUS AND SYSTEMS FOR CLEANING MULTIBLADED RAZOR DEVICES

(71) Applicant: ShaveSmart LLC, Woodinville, WA (US)

(72) Inventor: Greg Totonelly, Woodinville, WA (US)

(73) Assignee: SHAVESMART LLC, Woodinville, WA (US)

( * ) Notice: Subject to any disclaimer, the term of this patent is extended or adjusted under 35 U.S.C. 154(b) by 134 days.

(21) Appl. No.: 15/949,937

(22) Filed: Apr. 10, 2018

Related U.S. Application Data

(60) Provisional application No. 62/483,600, filed on Apr. 10, 2017.

(51) Int. Cl.

| | |
|---|---|
| ***A45D 27/46*** | (2006.01) |
| ***B08B 3/02*** | (2006.01) |
| *B26B 21/40* | (2006.01) |
| *B26B 21/22* | (2006.01) |

(52) U.S. Cl.
CPC ..... *A45D 27/46* (2013.01); *B08B 3/02* (2013.01); *B26B 21/222* (2013.01); *B26B 21/4087* (2013.01)

(58) Field of Classification Search
CPC ..... A45D 27/46
See application file for complete search history.

(56) References Cited

U.S. PATENT DOCUMENTS

| | | | | |
|---|---|---|---|---|
| 4,838,949 A * | 6/1989 | Dugrot | ..... | A45D 27/46 134/166 R |
| 4,941,492 A * | 7/1990 | Morgan | ..... | A45D 27/46 134/182 |
| 2008/0060671 A1 * | 3/2008 | Ruffin | ..... | A45D 27/46 132/292 |

* cited by examiner

*Primary Examiner* — Jason Y Ko
(74) *Attorney, Agent, or Firm* — DWC Law Firm, P.S.

(57) ABSTRACT

An apparatus for cleaning multibladed razor heads such as disposable razor cartridges of shaving razors. The apparatus may include a nozzle head, a neck for channeling cleaning fluid to the nozzle head, and a razor head retainer for receiving and holding in position, relative to the nozzle head, a razor head of a multibladed razor device. The nozzle head may include a plurality of spray orifices for spraying cleaning fluid onto the razor head. The plurality of spray orifices arranged in parallel rows of orifices, the nozzle head having a first side and a second side opposite of the first side and the spray orifices extending from the first side to the second side. The neck being connected to the first side of the nozzle head and the razor head retainer disposed adjacent to the second side of the nozzle head.

6 Claims, 12 Drawing Sheets

APPARATUS AND SYSTEMS FOR CLEANING MULTIBLADED RAZOR DEVICES

CROSS REFERENCE TO RELATED APPLICATION(S)

This application claims the benefit of U.S. Provisional Patent Application Ser. No. 62/483,600, filed on Apr. 10, 2017, which is incorporated herein by reference in its entirety.

BACKGROUND

1. Technical Field

The present disclosure relates to cleaning apparatuses, and in particular, to devices for cleaning multibladed shaving devices.

2. Description of Related Art

Multibladed razor devices have enjoyed increasingly popularity among consumers in recent years. Multibladed razor devices are commonly purchased toiletry items that are used, for example, to shave various parts of a person's body. These devices typically include a handle, and a multibladed razor head (herein simply "razor head"), which in some cases may be a disposable razor cartridge (hereinafter "multiblade cartridge"), with multiple blades that are generally arranged longitudinally in parallel with respect to each other. For multibladed razor devices that employ disposable multiblade razor cartridges, the disposable multiblade cartridges are each typically replaced on a regular basis, which can be relatively costly over the course of a year. Some currently commercially available multibladed razor systems include those that employ razor cartridges with three or five blades.

Accumulation of foreign matter such as beard stubble, body hair, and shaving cream between the blades of multibladed razor head is the primary obstacle to achieving the greatest number of shaves per cartridge. Also, foreign matter often accumulates behind stiffeners, which are support bars that are disposed on the backside of the multibladed razor head and are vertically oriented relative to the longitudinal direction of the blades. Accumulation of foreign matter behind stiffeners can also reduce the number of shaves that may be obtained from cartridges. Thus, effectively removing beard stubble and any other foreign matter between the blades of a multibladed cartridge, as well as behind stiffeners, can substantially extend the life of the multibladed cartridge.

SUMMARY

In some embodiments of the present disclosure, an apparatus is provided for cleaning the heads of multibladed razor devices. For these embodiments, the apparatus may include a nozzle head, a neck, and a razor head retainer. The nozzle head may include a plurality of spray orifice that are arranged in parallel rows of orifices. The nozzle head may have a first side and a second side opposite of the first side and the spray orifices extending from the first side to the second side.

The neck may be in fluid communication with the nozzle head by having a conduit for channeling cleaning fluid to the first side of the nozzle head. The razor head retainer may be located adjacent to the second side of the nozzle head and may have one or more slots for receiving one or more portions of a multibladed razor head, whereby the razor head retainer is for positioning and holding the multibladed razor head in a particular orientation relative to the nozzle head to ensure that blades of the multibladed razor head are each aligned with the parallel rows of the spray orifices of the nozzle head.

In some embodiments of the present disclosure, a razor head cleaning system is provided. The razor head cleaning system may include a fluid supply apparatus, a nozzle head, a neck, a razor head retainer, and at least one skirt. The fluid supply apparatus is for supplying a fluid such as a cleaning fluid. The nozzle head may include a plurality of spray orifices arranged in parallel rows.

The neck may have a first end and a second end, the neck connected at the first end via a connector to the fluid supply apparatus and connected at the second end to one side of the nozzle head, the neck includes a conduit extending from the first end to the second end for channeling cleaning fluid from the fluid supply apparatus to the plurality of spray orifices. The razor head retainer may be disposed adjacent to a side of the nozzle head that is opposite from the side of the nozzle head connected to the neck and having one or more slots for receiving and holding one or more portions of a multibladed razor head. The at least one skirt may be disposed adjacent to a side of the razor head retainer that is opposite from a side of the razor head retainer that is adjacent to the nozzle head, the at least one skirt at least partially defining a cavity through which cleaning fluid that flows through the multibladed razor head is directed downwards away from the razor head retainer.

DETAILED DESCRIPTION

Figure 1A:
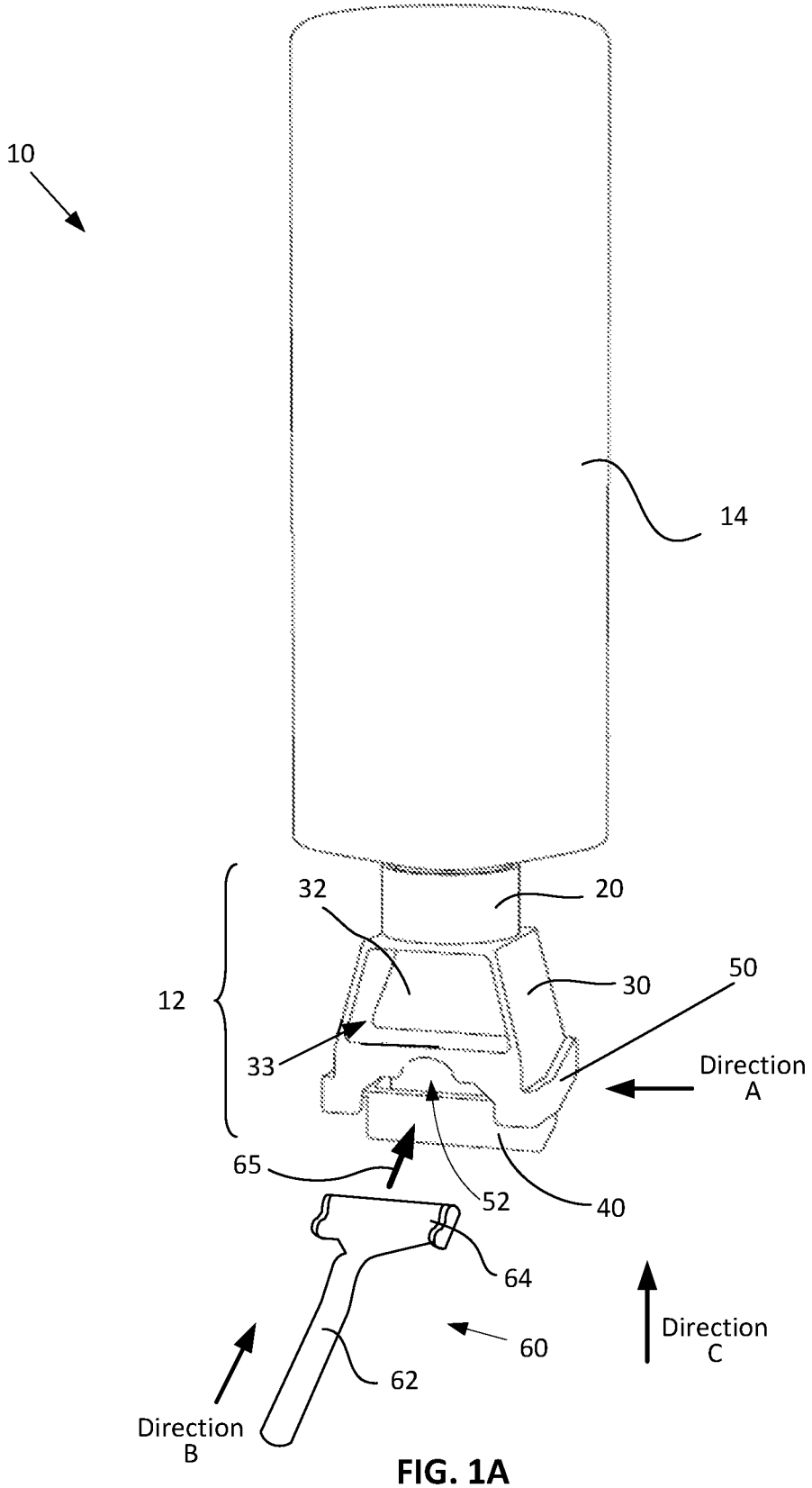
FIG. 1A is a perspective view of an example razor head cleaning system according to some embodiments.

In the present description, certain specific details are set forth in order to provide a thorough understanding of various embodiments of the disclosure. However, upon reviewing this disclosure one skilled in the art will understand that the various embodiments disclosed herein may be practiced without many of these details. In other instances, some well-known structures and materials of construction have not been described in detail to avoid unnecessarily obscuring the descriptions of the embodiments of the disclosure.

In the present disclosure, to the extent the terms "about" and "approximately," are used, they mean±20% of the indicated range, value, or structure, unless otherwise indicated. In the present description, the terms "a" and "an" as used herein refer to "one or more" of the enumerated components. The use of the alternative (e.g., "or") should be understood to mean either one, both, or any combination thereof of the alternatives. As used herein, the terms "include" and "comprise" are used synonymously, the terms and variants of which are intended to be construed as non-limiting. The definitions in this paragraph are intended to apply throughout this disclosure unless otherwise expressly stated.

In some embodiments of the present disclosure, an apparatus referred to herein as a "razor head cleaning nozzle" is provided that may be employed for cleaning a razor head of a multibladed razor device. The razor head cleaning nozzle may be employed both as a cleaning apparatus and a water conservation device for users of multibladed razor devices. In various embodiments, the razor head cleaning nozzle is configured to be coupled to a fluid supply apparatus such as a squeezable fluid bottle, a hose, or a spigot. When the razor head cleaning nozzle is in fluid communication with a fluid supply apparatus, the combination of these devices will be referred to herein as a "razor head cleaning system" (as opposed to "razor head cleaning nozzle").

When attached to a fluid supply apparatus such as an ordinary water squeeze bottle, or other fluid supply apparatus, the razor head cleaning nozzle may convey water (or other hypo-allergenic fluid) in a concentrated spray pattern that removes beard stubble or any other foreign matter trapped between the blades of a multibladed razor device in a manner that 1) is more effective than the conventional methods of either running tap water over the razor head of the multibladed razor device or rigorously 'sloshing' the razor head in a basin of water, and 2) reduces the volume of water consumed for blade cleaning during and after each shave. While shaving, consistent removal of beard stubble trapped between the blades has been demonstrated to more than double the number of close comfortable shaves that can be derived from each multibladed razor heads (e.g., multiblade cartridge).

In various embodiments, and as will be further illustrated herein, a razor head cleaning nozzle is provided that may include at least a nozzle head (e.g., a spray nozzle) and a razor head retainer (e.g., a retainer for holding a multibladed razor head under the nozzle head). In some embodiments, the razor head retainer and the nozzle head detailed herein may be used for receiving and cleaning multibladed razor heads of multibladed razor devices such as those that employ three or five bladed razor heads. As will be further described herein, a razor head cleaning nozzle, in addition to the nozzle head and the razor head retainer, may further include a connector (for connecting the razor head cleaning nozzle to a fluid supply apparatus such as a fluid bottle), a neck that is in fluid communication with the nozzle head including having a conduit for delivering cleaning fluids from a liquid supply apparatus to the nozzle head, and at least one shroud (hereinafter "skirt") disposed below the nozzle head for directing cleaning fluid used to clean a razor head downwards towards, for example, a sink.

In various embodiments, different implementations of the razor head cleaning nozzle may be provided that can accommodate razor heads of different multibladed razor devices made by, for example different manufacturers. In brief, and as will be further described herein, the razor head retainer of the razor head cleaning nozzle, in accordance with various embodiments, may be designed to hold in place in a particular orientation the razor head of a multibladed razor device relative to the nozzle head of the razor head cleaning nozzle. The nozzle head, in contrast, is designed to spray high-velocity fluids onto the razor head being held in place by the razor head retainer.

Cleaning Methodology

In various embodiments, the razor head cleaning system (e.g., a razor head cleaning nozzle and a fluid supply apparatus) may deliver high velocity streams of water (e.g., by throttling or restricting flow and forcing the water through a restrictive flow patch with pressure) or any other hypo-allergenic fluid to the blades and the spacing between the blades of a multibladed razor head (e.g., multibladed razor cartridge). The high velocity streams may be delivered in a pattern that corresponds to the configuration of the multibladed razor and its handle attachment mechanisms and to the regions between the blades where accumulations of beard/hair stubble and shaving cream build up. As a result, the accumulations are flushed out and optimal shaving status may be restored to the multibladed razor head.

Method of Use

In some embodiments, fluid supply apparatuses may be employed that may include ordinary water squeeze bottles, faucets, hoses, and pump systems for supplying water or any other hypo-allergenic fluid to the razor head cleaning nozzle. For example, in some cases, an ordinary water squeeze bottle may be employed as the water delivery mechanism and manual squeezing may be sufficient to pressure the water through one or more throttling/restriction locations of the razor head cleaning nozzle In some cases, users may attach or thread the razor head cleaning nozzle onto a water bottle and store the combined apparatus on a bathroom countertop, on the perimeter of a tub, or in a shower stall with the razor head cleaning nozzle pointed up (e.g., the water bottle sitting on the countertop and the razor head cleaning nozzle on the topside of the water bottle). Replenishing the water (or any other hypo-allergenic fluid) in the bottle may be a simple matter of removing or unscrewing the razor head cleaning nozzle from the water bottle, filling the water bottle, and reattaching or threading the razor head cleaning nozzle back on to the water bottle.

To clean a razor head (e.g., disposable multibladed cartridge) of a multibladed razor device, a user may grasp the water bottle, rotate the bottle such that the water bottle is upside down so that the razor head cleaning nozzle is on the bottom side of the water bottle. The razor head of the multibladed razor device is then inserted into the razor head retainer of the razor head cleaning nozzle where it is retained in the proper orientation for cleaning. Users may then squeeze the water bottle to flush the accumulations of beard/hair stubble and shaving cream from the blade. As will be further described herein, the razor head cleaning nozzle may include at least one skirt that is configured to contain lateral splattering of cleaning fluids discharged by the nozzle head of the razor head cleaning nozzle and that was used to clean the blades of multibladed razor head. The skirt may also direct the used cleaning fluid, in the case of sink-based shaving, to the bottom of the sink thus minimizing the need for cleaning beard stubble and shaving cream splatter from the sink bowl and countertop after shaving.

Performance Benefits

The use of the razor head cleaning system for cleaning multibladed razors have been shown to extend the optimal shaving performance level of razor heads (e.g., razor cartridges) of multibladed razor devices. By maintaining optimal shaving performance of razor heads of multibladed razors in this manner, 104 close-comfortable shaves per razor head have been achieved with two well-known commercially available multibladed cartridges. This is in marked contrast to the 21 shaves derived from each razor head cleaned/flushed using conventional approaches (e.g., with a faucet or 'sloshing' cleaning techniques) that do not effectively remove beard stubble resulting in a concentrated build-up of stubble that over time may severely curtail the effectiveness of the razor. More pronounced is the difference between the manufacturer's suggested optimal number of shaves per razor head, as determined by the colored gel strip on the face of each razor head which fades to indicate that it is time to replace the razor head. On average the gel strip fades after 10 to 14 shaves. These figures may result in an increase of the utility of each commercially available multibladed cartridge by a factor of 4.95 and 7.42 respectively. Conversely, they may represent a decrease in the annual purchasing costs of the commercially available multibladed cartridges by 73% and 82% respectively.

Over several test trials, each test trial involving approximately four months of shaves and shaving at a rate of six times per week, a total of 104 shaves on average per razor cartridge was achieved.

Water Conservation

Experimentation has shown that to maintain optimal blade shaving performance throughout the course of a facial shave, razor heads need to be cleaned/flushed an average of five times during a complete facial shave. In comparing the water consumption rates of each of three methods of cleaning/flushing (e.g., using the disclosed razor head cleaning system that generates a high-pressure spray pattern, running water from a faucet, and sloshing the razor heads in an approximately 1" deep pool of water at the bottom of a typical vanity sink), the following consumption rates were noted:

High Pressure Spray Pattern: 240 ml of water used to clean a razor head during a complete shave (e.g., approximately 5 blade cleanings).

1" Deep Pool at Bottom of Sink: 475 ml

Running Faucet Five (5) Times: 500 ml

The following example scenario is provided to illustrate the potential magnitude of the conservation issue.

Publicly available data suggests that on or more major razor blade manufacturers has 600 million plus users of its products. If each of these users were to substitute a high-pressure spray pattern cleaning method, such as disclosed herein, for the 'running the faucet' cleaning method, over the course of one year and five shaves per week, approximately 29,629 acre-feet of water could be conserved annually. This is equivalent in size to a small fresh water reservoir in the United States. In addition to conservation considerations the reduction in the related demand placed on waste water treatment facilities and subsequently to the eco-system bears mentioning.

For users in developing countries where access to clean fresh water is limited, the benefit of minimizing the volume of water required to maintain a razor in optimal shave status may be significant. Multibladed razor devices, in contrast to single-bladed non-safety razor devices, reduce the likelihood of shaving-related nicks and cuts and therefore should be considered good public health policy. In addition to dramatically reducing the costs associated with the ownership of each razor blade device, the disclosed razor head cleaning nozzle and system may facilitate the increased adoption of multibladed razor devices in these markets by virtue of the reduced amount of water that is necessary, using the disclosed razor head cleaning nozzle, for razor head cleaning during shaving.

Reduction in Waste

In some cases, usage of the disclosed razor head cleaning nozzle and system to clean the razor heads of multibladed razor devices may optimize the number of shaves per razor head and therefore may reduce the number of razor heads (e.g., disposable multiblade cartridges) used on an annual basis resulting in a reduction in razor head waste as well as that of packaging. In the extreme, if all 600,000,000 customers of the manufactures of the multibladed devices such as referenced above used the disclosed razor head cleaning system (conservatively 45 shaves per razor head) in lieu of conventional cleaning methods (liberally 21 shaves per razor head) over the course of one year with five shaves per week, the reduction in razor head waste (excluding packaging) could amount to 112,500 tons annually.

FIG. 1A is a perspective view of a razor head cleaning system in accordance with various embodiments. The illustrated razor head cleaning system 10 includes a razor head cleaning nozzle 12 attached to a fluid supply apparatus 14, which in this case is a fluid bottle (e.g., a plastic bottle or any other type of squeezable/flexible bottle for storing water and/or or any other hypo-allergenic fluid). Illustrated in FIG. 1A is a multibladed razor device 60 with a handle 62 and a multibladed razor head 64 (hereinafter razor head 64). In order to clean the razor head 64 of the multibladed razor device 60, the razor head 64 may be inserted into a receiving bay opening 52 of the razor head cleaning nozzle 12 as represented by arrow 65. The receiving bay opening 52 being of sufficient size to receive at least the forward portion of the handle 62 and the razor head 64 of the multibladed razor device 60.

In various embodiments, the razor head cleaning nozzle 12 may include a connector 20, a neck support structure 30 including a neck 32 disposed therein, and a nozzle head support structure 50. As will be further described herein, disposed at least partially within the nozzle head support structure 50 is a nozzle head 80, a razor head retainer 82, and a skirt 40 that extends out of the bottom of the nozzle head support structure 50 (see, for example, FIGS. 7 and 8A). The neck 32 being in fluid communication with the nozzle head 80. Skirt 40 may prevent the spray of cleaning fluid from spraying upwards and laterally towards the user during razor head cleaning and instead, direct the cleaning fluid downwards and away from the user. Skirt 40 may be made of plastic, rubber, ceramic, and/or other suitable materials.

In the embodiment illustrated in FIG. 1A, the connector 20 is a female connector in the form of a threaded cap that is configured to be threaded onto a male connector of the fluid supply apparatus 14. In some embodiments, the female connector may be made of a variety of materials including plastic, rubber, ceramic, metal, and/or other materials. Note that although the fluid supply apparatus 14 is illustrated as being a fluid bottle, in other embodiments, the fluid supply apparatus 14 may be a hose, a spigot, or other water supply sources. In the embodiment illustrated in FIG. 1A, the neck support structure 30 having a void 33 (e.g., a cavity) in which the neck 32 is disposed therein. The neck 32 may include a conduit 36 (see, for example, FIGS. 7 and 8A) that provides a channel for cleaning fluid to flow from the fluid supply apparatus 14 to the nozzle head 80.

In order to facilitate the following discussion, directions A, B, C, and D are provided in FIG. 1A to provide a frame of reference when certain relative terms such as front, back, bottom, top, and so forth are used. For example, when the razor head cleaning system 10 is viewed from direction B, the side of the razor head cleaning system 10 that will be visible will be referred to as the front-side of the razor head cleaning system 10. If, on the hand, if the razor head cleaning system 10 is viewed from direction C, the side of the razor head cleaning system 10 that will be visible will be referred to as the bottom-side of the razor head cleaning system 10. In contrast, if the razor head cleaning system 10 is viewed from direction A, the side of the razor head cleaning system 10 that will be visible will be referred to as the right-side of the razor head cleaning system 10.

Figure 1B:
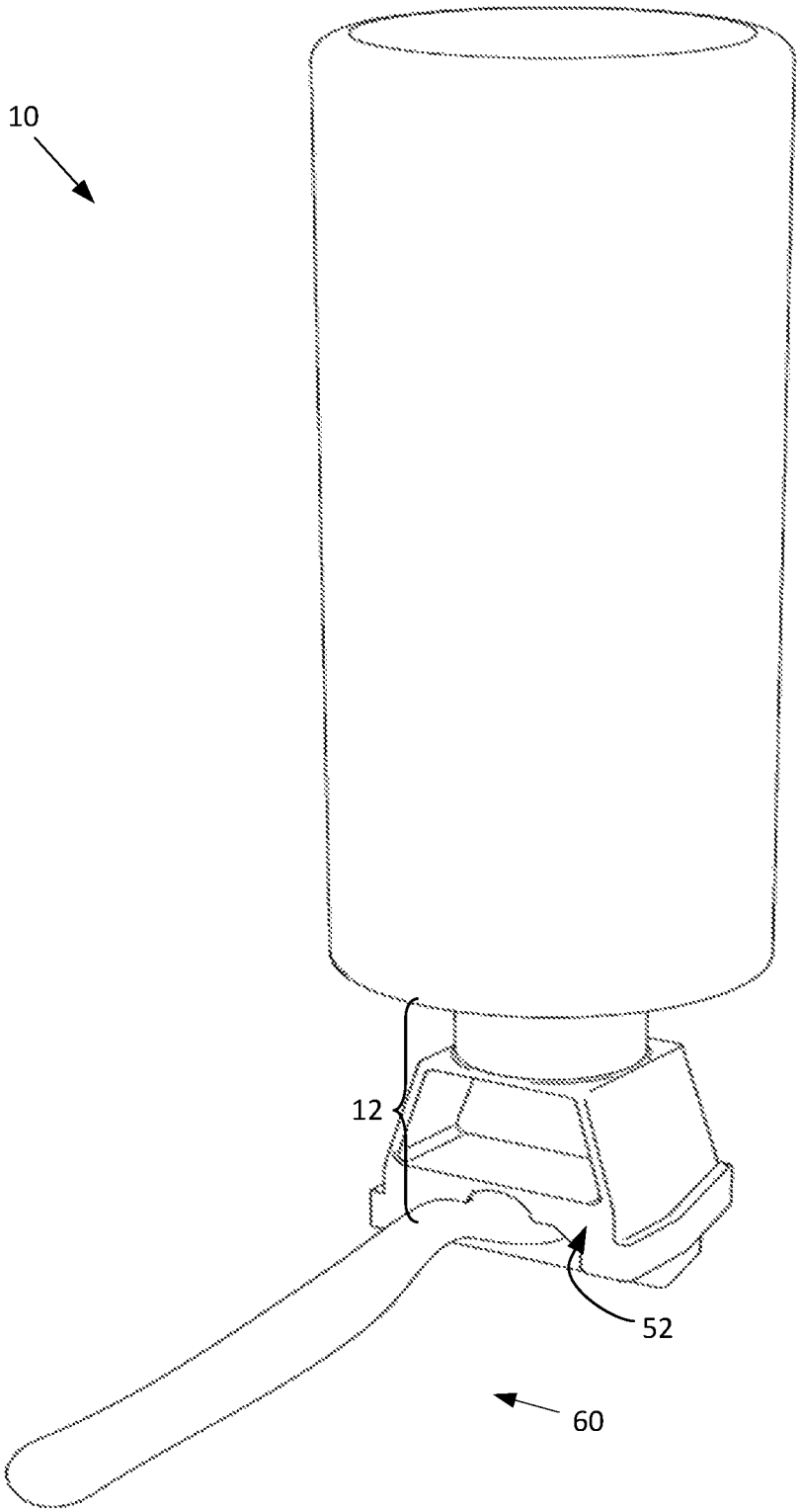
FIG. 1B is another perspective view of the example razor head cleaning system of FIG. 1A, with a razor head of a multibladed razor device inserted into a receiving bay opening of the razor head cleaning system.
Figure 2A:
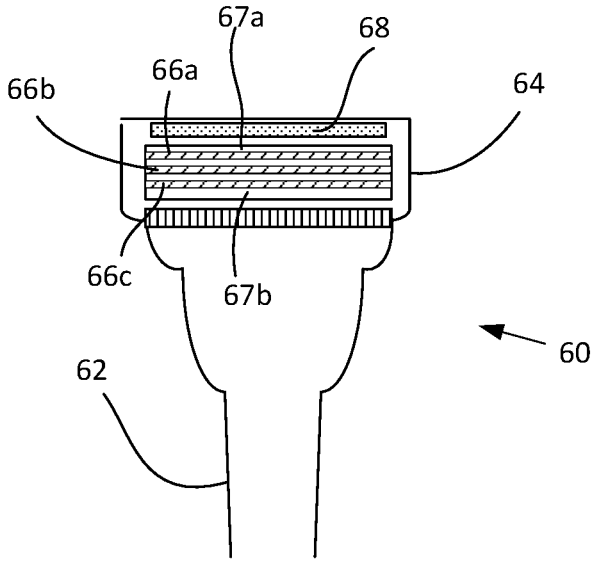
FIG. 2A is a frontside view of an example razor head illustrated in FIG. 1A.
Figure 2B:
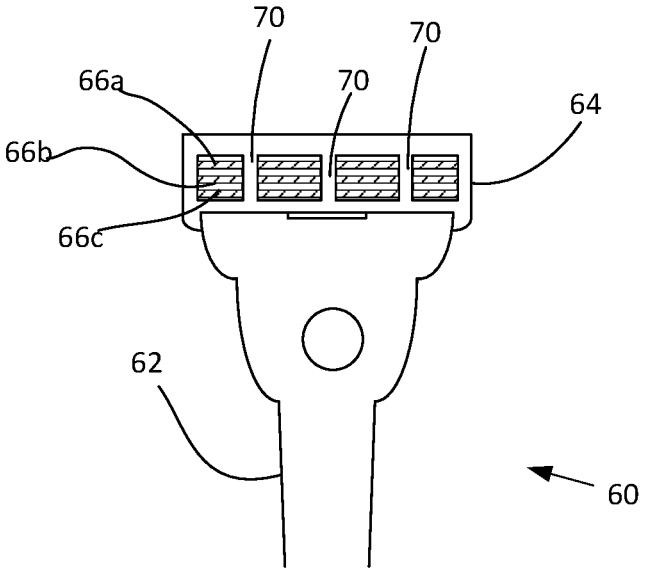
FIG. 2B is a backside view of the example razor head illustrated in FIG. 1A.

FIG. 1B is another perspective view of the razor head cleaning system 10 of FIG. 1A when the razor head 64 of the multibladed razor device 60 has been inserted into the receiving bay opening 52 of the razor head cleaning nozzle 12. FIGS. 2A and 2B are frontside and backside views, respectively, of the razor head 64 of the multibladed razor device 60 of FIGS. 1A and 1B. More particularly, FIG. 2A shows the frontside of the razor head 64 that is used to shave, for example, a body part such as a chin. The illustrated razor head 64 includes a plurality of blades, in this case, three blades 66*a*, 66*b*, and 66*c* that are arranged longitudinally in parallel. Note that in the following "*" represents a wildcard. Thus, references in the following description to, for example, a blade 66* may be in reference to blade 66*a*, blade 66*b*, or blade 66*c*.

Disposed on one side of the blades 66 is a colored gel strip 68, the color of which will fade after a certain number of usage (e.g., to remind users when to replace the razor head 64). Visible on the backside of the razor head 64 in FIG. 2B are the three blades 66. Disposed on the backside of the razor head are stiffeners 70, which are support structures.

During shaving, foreign matter such as bear stubble, body hair, and shaving cream tend to accumulate in certain locations such as between the two spaces between the three blades 66*, the top perimeter space 67*a* adjacent to blade 66*a*, the bottom perimeter space 67*b* adjacent to blade 66*c*, and between the stiffeners 70 and the blades 66* (see FIG. 2B). Note that removal of foreign matter that is stuck behind the stiffeners 70 is generally very difficult, if not impossible, using conventional cleaning techniques such as by placing the razor head 64 under a running faucet as it requires substantial lateral force to dislodge the foreign matter from underneath the stiffeners 70. As will be further illustrated and described herein, the disclosed razor head cleaning nozzle 12, and in particular, the nozzle head 80 of the razor head cleaning nozzle 12 is designed to remove such foreign material during cleaning of a razor head 64.

Figure 3A:
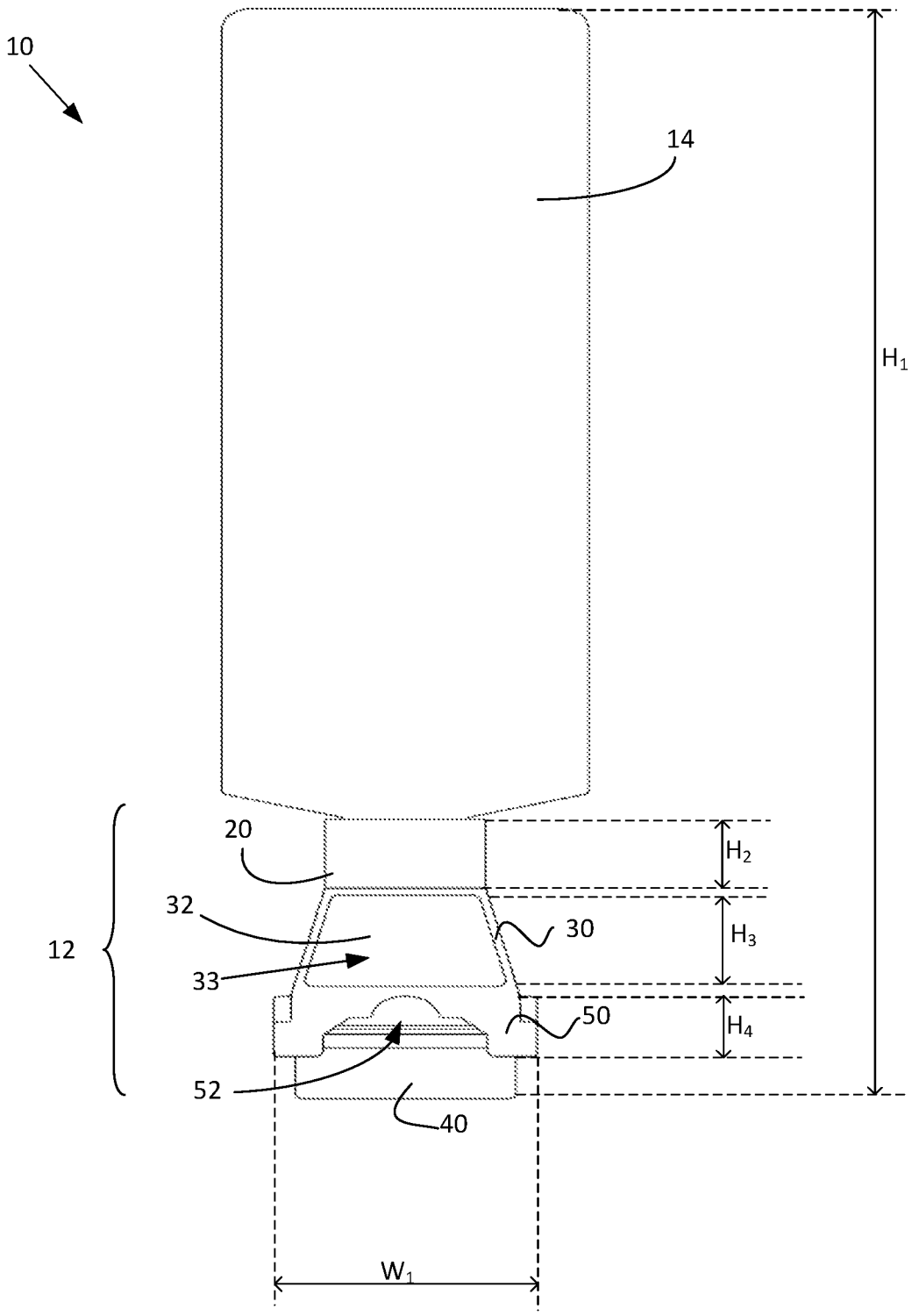
FIG. 3A is an elevation view of the frontside of the razor head cleaning system of FIG. 1A.

FIG. 3A is an elevation view of the frontside of the razor head cleaning system 10 of FIG. 1A (e.g., the view of the razor head cleaning system 10 from direction B of FIG. 1A). As previously noted, the razor head cleaning nozzle 12 includes a connector 20, a neck support structure 30, and a nozzle head support structure 50. Disposed within a void 33 (not visible in FIG. 3A but shown in FIG. 1A) of the neck support structure 30 is a neck 32, which extends from one side of the void 33 to the other side of the void 33. Connected to the bottom of the neck support structure 30 is the nozzle head support structure 50. Disposed at least partly within the nozzle head support structure 50 is a nozzle head 80 (see FIGS. 6, 7A, and 7B), a razor head retainer 82 (see FIGS. 7A and 7B), and at least one skirt 40 (which in the embodiment of FIG. 3A extends out from the bottom of the nozzle head support structure 50).

Figure 9:
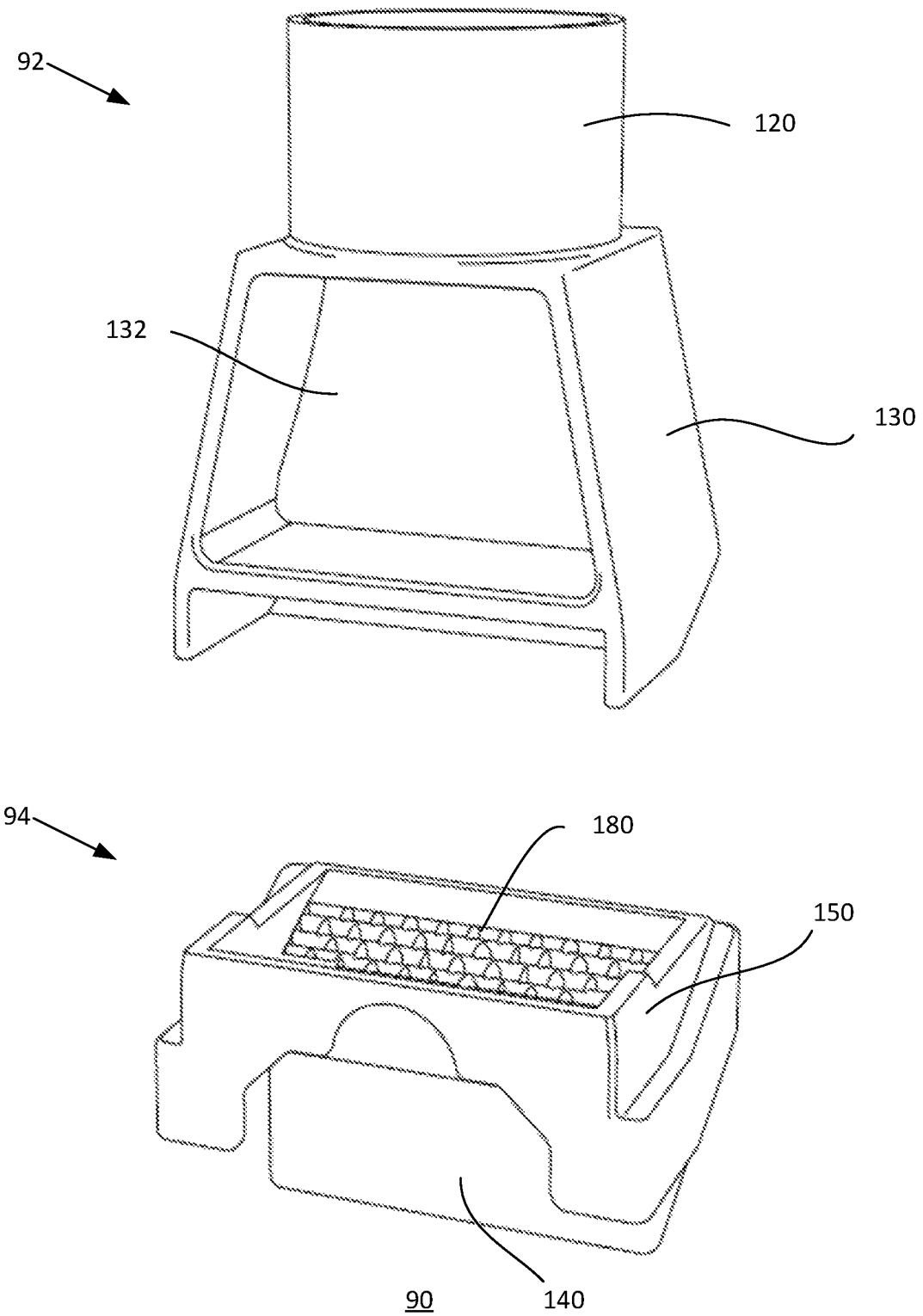
FIG. 9 is a perspective view of a razor head cleaning nozzle with an interchangeable spray head attachment in accordance with various embodiments.

In some embodiments, the various components of the razor head cleaning nozzle 12 including the connector 20, the neck support structure 30 (including neck 32), the nozzle head support structure 50, and in some cases related components (e.g., nozzle head 80, razor head retainer 82, and skirt 40) may be a single monolithic component. In alternative embodiments, however, the razor head cleaning nozzle 12 may be an assembly of separate components such as illustrated in FIG. 9.

Figure 3B:
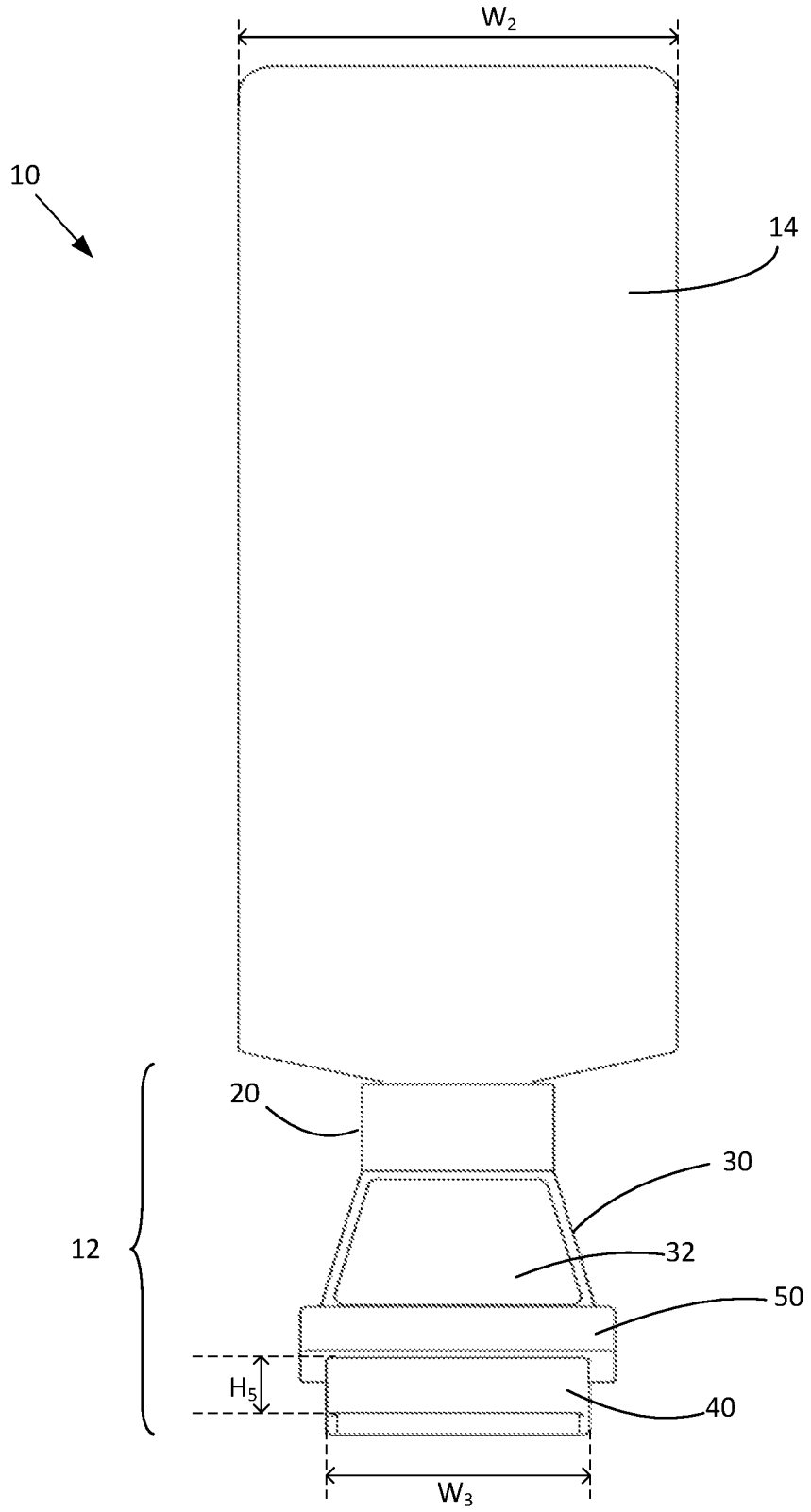
FIG. 3B is an elevation view of the rear-side of the razor head cleaning system of FIG. 1A.

FIG. 3B is an elevation view of the rear-side of the razor head cleaning system 10 of FIG. 1A. In the embodiment illustrated in FIG. 3B, the skirt 40 extends below the nozzle head support structure 50.

Figure 4:
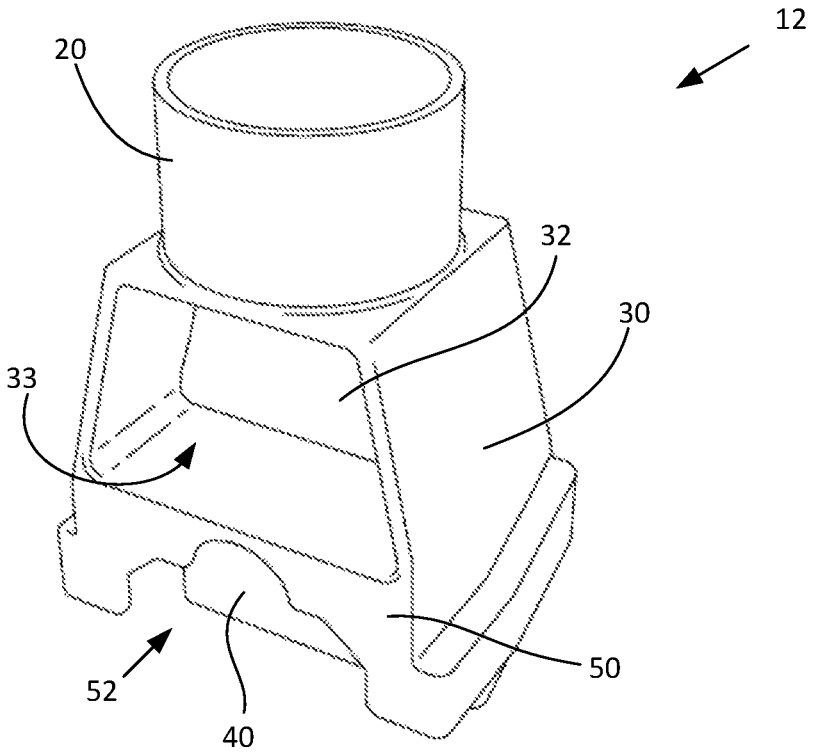
FIG. 4 is a perspective view of the razor head cleaning nozzle of FIG. 1A.

FIG. 4 is a perspective view of the razor head cleaning nozzle 12 of FIG. 1A. In the embodiment illustrated in FIG. 4, connector 20 is a female connector that is designed to couple with a male connector of fluid supply apparatus 14. As more clearly shown in FIG. 4, the neck support structure 30 defines a partially filled void 33. A generally elongated neck 32 is disposed in the void 33. In the illustrated embodiment, the neck 32 extends from one side of the void 33 to the other side (e.g., in FIG. 4, extending from the left side of the void 33 to the right side of the void—note the right side of void 33 is not shown in FIG. 4).

Figure 5:
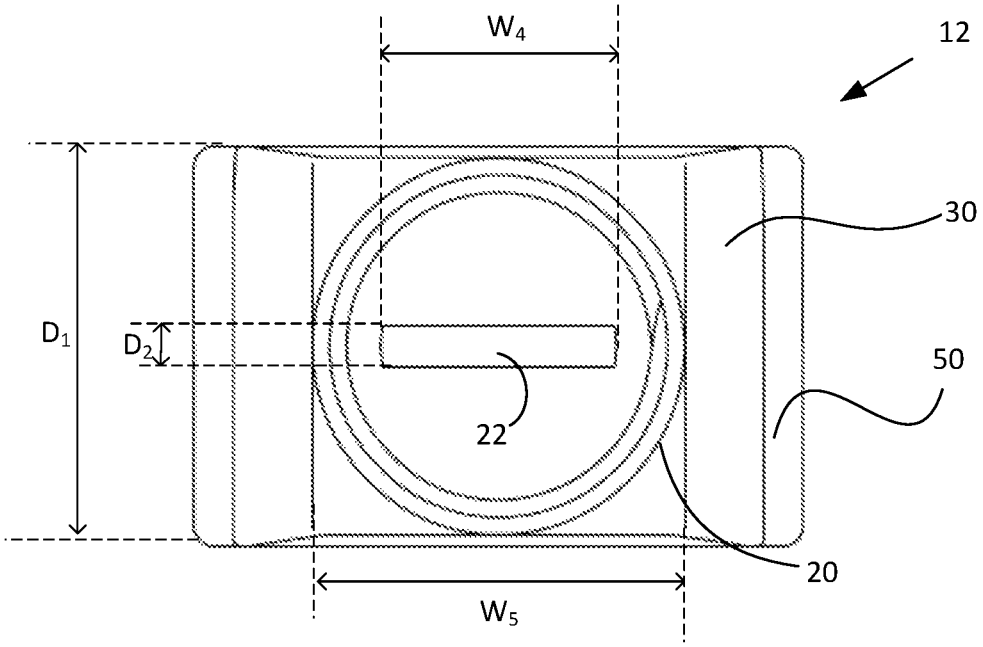
FIG. 5 is a plan view of the razor head cleaning system of FIG. 1A.

FIG. 5 is a plan view of the razor head cleaning nozzle 12 of FIG. 1A. As illustrated, disposed at the bottom of the connector 20 a conduit opening 22 that is an opening for the conduit 36 (see FIGS. 7 and 8A) that goes through the neck 32. As will be further described herein, the conduit 36 of the neck 32 is a channel that permits fluids to flow from the fluid supply apparatus 14 to flow to the nozzle head 80 disposed at least partly in the nozzle head support structure 30. In some embodiments, and as will be further described herein, the conduit 36 is a constricted conduit in which a portion of the conduit 36 will be constricted with a smaller cross-sectional area than other portions of the conduit 36. As previously illustrated, the connector 20 is connected to a neck support structure 30, which sits atop the nozzle head support structure 50. In the illustrated embodiment of FIG. 5, the connector 20 is a female connector in the form of a threaded cap.

Figure 6:
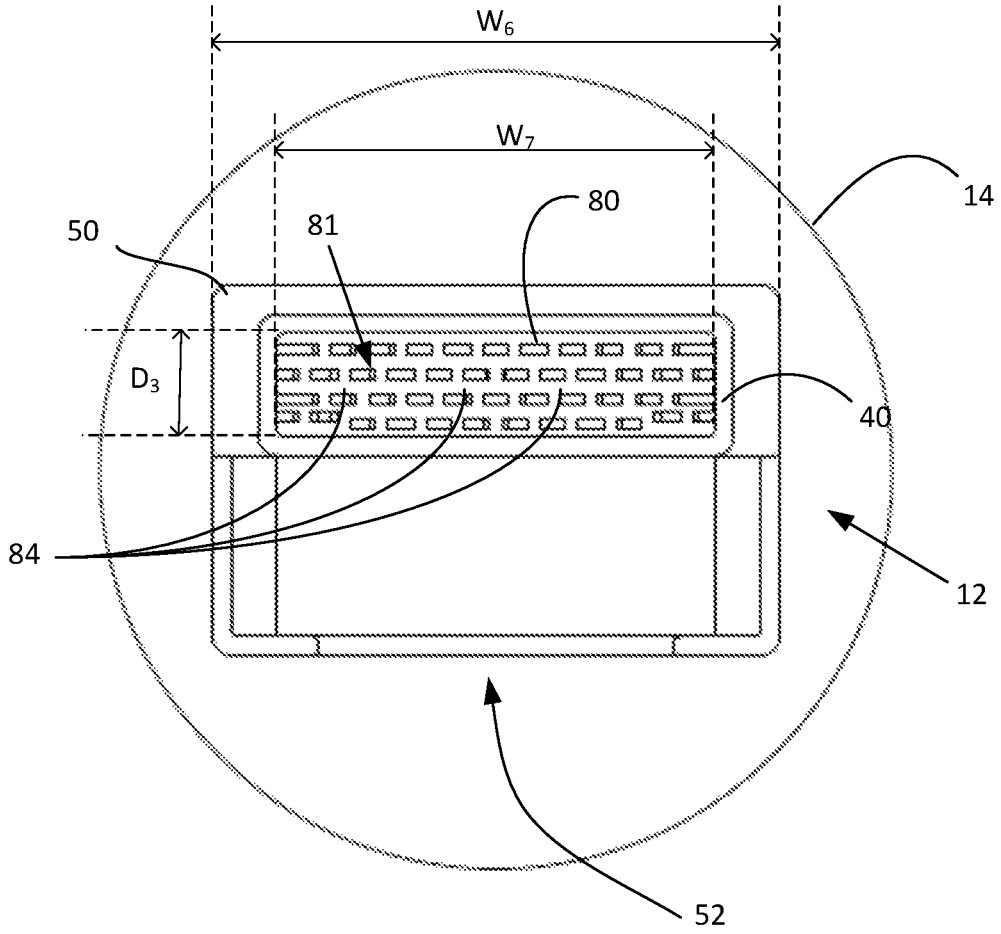
FIG. 6 is a bottom view of the razor head cleaning system of FIG. 1A.

FIG. 6 is a bottom view of the razor head cleaning system 10 of FIG. 1A. Disposed within the nozzle head support structure 50 is a nozzle head 80, which is partially visible through an opening 81 in the nozzle head support structure 50. The skirt 40 encircles opening 81 and extends away from nozzle head support structure 50 (e.g., downwards in FIG. 1A). In the embodiment illustrated in FIG. 6, skirt 40 is a single continuous skirt that extends away (e.g., downwards in FIG. 1A) from opening 81 so that cleaning fluids that are sprayed by the nozzle head 80 and that drain out of the opening 81 can be contained with minimal lateral splattering. In some alternative embodiments, multiple and separate skirts 40 may be employed as one of ordinary skill in the relevant art will recognize.

The nozzle head 80 may include a plurality of spray orifices 84 (or simply "orifices 84") that are high-velocity spray holes. In the illustrated embodiment of FIG. 6, the orifices 84 are arranged into four longitudinal rows of orifices 84. This arrangement of orifices 84 may be particularly useful for cleaning, for example, three-bladed razor heads such as the one illustrated in FIGS. 2A and 2B. For example, with respect to the razor head 64 of FIGS. 2A and 2B, the four rows of orifices 84 may be designed to spray high-pressure cleaning fluid to the spacing between the three blades 66*, and the perimeter spacing above blade 66*a* and the perimeter spacing below blade 66*c*.

In some embodiments, at least some of the orifices 84 may be directional orifices that directs high pressure cleaning fluids in longitudinal angles (e.g., in FIG. 6, the spray generated from one or more of the orifices 84 would be directed out of the page and angled to the left or angled to the right) in order to remove, for example, foreign matter disposed behind the stiffeners 70 of the razor head 64. That is, spraying cleaning fluids at or near 90-degree angles with respect to the backside of the razor head 64 (see FIG. 2B) will often be minimally effective in removing, for example, foreign matter stuck behind stiffeners 70 of razor head 64. Thus, in various embodiments, when the backside of a razor head 64 (see the backside of razor head 64 in FIG. 2B) is placed underneath the orifices 84, the cleaning fluid discharged by at least some of the orifices 84 will be directed to the backside of a razor head 64 angled longitudinally (e.g., left to right or right to left in FIG. 2B). Arrows 85 in FIG. 7, which shows a cut-out view of the razor head cleaning nozzle 12 from direction B in FIG. 1A, represents the longitudinal angles that at least some of the orifices 84 discharge the cleaning fluids. In one embodiment, some or all of the orifices 84 may have a cross sectional area equivalent to an area of a rectangle having dimensions of 2.0 millimeter by 0.74 millimeter.

Illustrated in FIG. 6 is a receiving bay opening 52 through which a razor head 64 of a multibladed razor device 60 can be inserted into the nozzle head support structure 50 of the razor head cleaning system 10. Note that if a razor head 64 had been inserted through the receiving bay opening 52, the nozzle head 80 and its orifices 84 would not be visible in FIG. 6.

Figure 7:
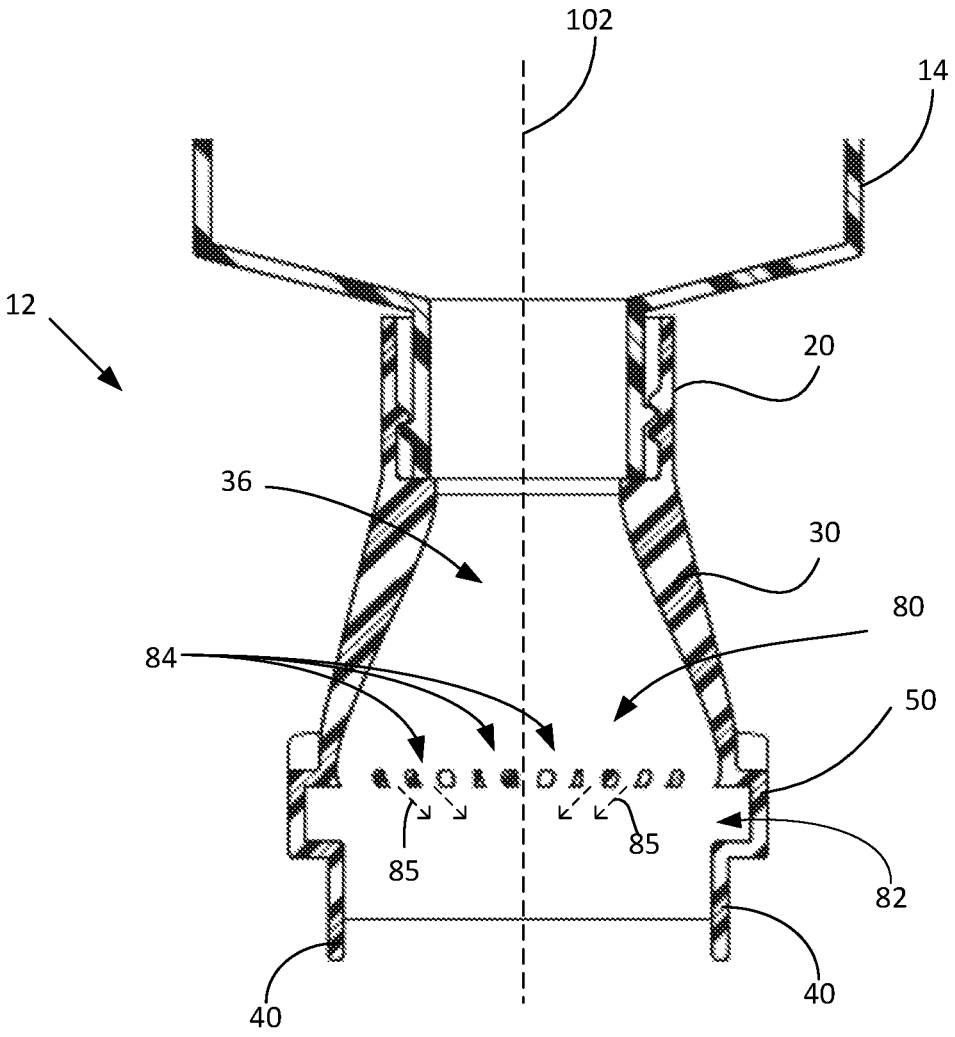
FIG. 7 is a cutaway frontside view of the razor head cleaning nozzle illustrated in FIG. 1A.

FIG. 7 is a cutaway frontside view of the razor head cleaning nozzle 12 illustrated in FIG. 1A. More particularly, FIG. 7 is a cutaway view of the razor head cleaning nozzle 12 and the bottom of the fluid supply apparatus 14 viewed from direction B in FIG. 1A. As illustrated, conduit 36 of neck 32 (which is not visible in FIG. 7, but visible in the side cutout view of FIG. 7B) extends from connector 20 to the nozzle head 80.

Disposed in the nozzle head 80 are a plurality of orifices 84. Below the nozzle head 80 is a razor head retainer 82, which in some embodiments, may comprise of one or more slots or crevices for receiving one or more portions of, for example, a razor head 64. Note that in FIG. 7, there are slots left and right side of the razor head retainer 82 for holding ends of a razor head 64. In various embodiments, the razor head retainer 82 may be for positioning and holding a razor head 64 in a particular orientation relative to the nozzle head 80 to ensure that blades 66* of the razor head 64 are each aligned with the parallel rows of the orifices 84 of the nozzle head 80.

In various embodiments, at least some of the orifices 84 are directional orifices because the high velocity fluids that are discharged by these orifices 84 are directed downwards and at angles in longitudinal directions (see arrows 85 in FIG. 7) with respect to the blades 66* of a razor head 64 that is inserted into the razor head retainer 82. In particular, when a razor head 64 is inserted into the razor head retainer 82, the backside of the razor head 64 (see FIG. 2B) will be facing the orifices 84 and the blades 66* of the razor head 64 will be oriented left to right (or right to left) in the view illustrated in FIG. 7. The stiffeners 70 of the razor head 64 are perpendicular to the blades 66* and oriented parallel to the bottom surface of the nozzle head 80. As a result, cleaning fluids that are directed straight down towards the backside of the razor head 64 will have minimal impact in removing foreign matter stuck behind the stiffeners 70. Whereas, cleaning fluids that are sprayed angled in longitudinal directions as represented by arrows 85 in FIG. 7 may be more effective in removing such foreign matter.

Disposed below the razor head retainer 82 is skirt 40. Although not clearly illustrated in FIG. 7, the bottom of the skirt 40 may be sloped. For example, in some embodiments, the skirt 40 may be sloped up at 22.5 degrees.

Figure 10:
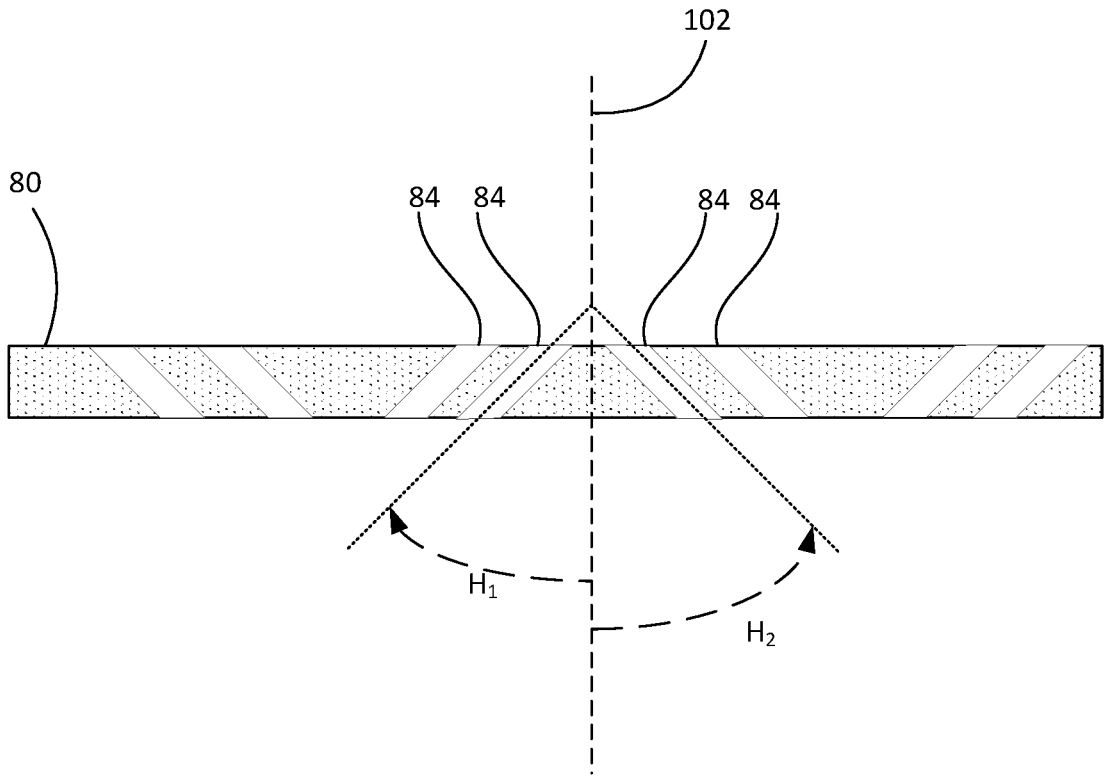
FIG. 10 is a cross-sectional close-up view of the nozzle head illustrated in FIG. 7.

Turning to FIG. 10, which is a cross-sectional close-up view of the nozzle head illustrated in FIG. 7. In order for the nozzle head 80 to spray cleaning fluid directionally (e.g., angled in the longitudinal direction relative to the blades 66* of a razor head 60 inserted into the razor head retainer 82) so that foreign matter, such as bear stubs and shaving cream stuck behind stiffeners 70 of a razor head 64, can be dislodged, one or more of the orifices 84 of the nozzle head 80 may be angled with respect to a vertical axis 102 (see also FIG. 7) of the fluid supply apparatus 14 (e.g., fluid bottle) and/or the razor head cleaning system 10. In the embodiment illustrated in FIG. 10, two of the orifices 84 are angled H1 and H2 away from the vertical axis 102. In some embodiments, one or more of the orifices 84 may be angled between 30 degrees and 90 degrees away from the vertical axis 102. In some embodiments, the connector 20 may have a cylindrical shape, and the vertical axis 102 corresponds to or parallels the center vertical axis of the cylindrical shaped connector 20.

Figure 8A:
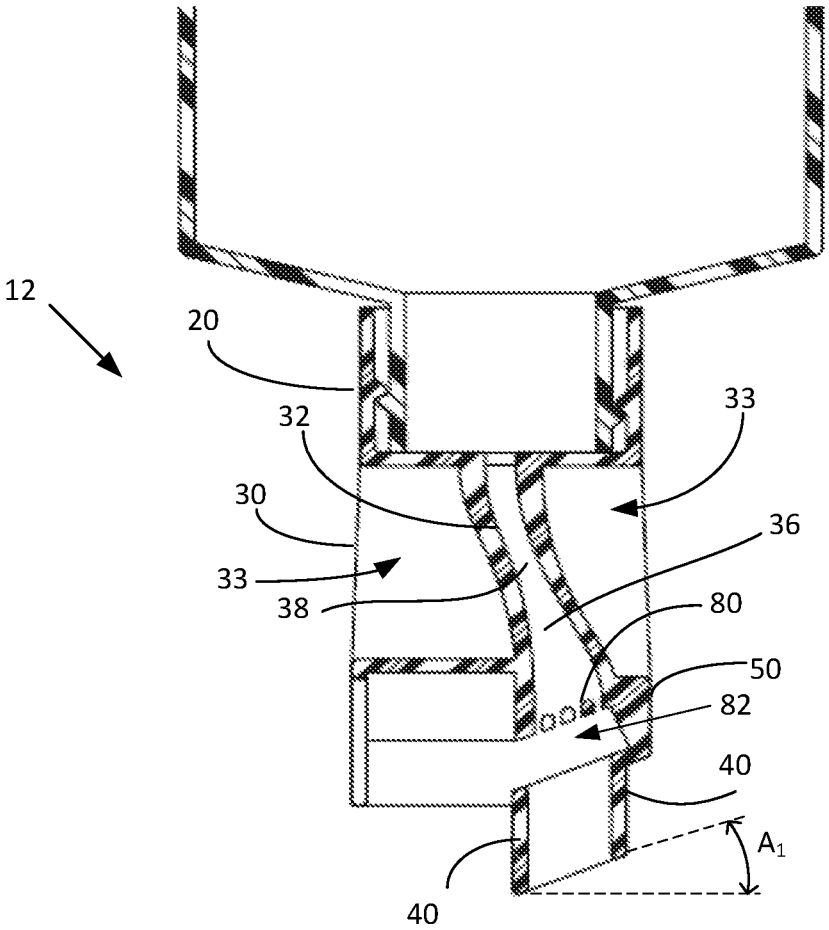
FIG. 8A is a cutaway sideview of the razor head cleaning nozzle illustrated in FIG. 1A.

FIG. 8A is a cutaway sideview of the razor head cleaning nozzle 12 illustrated in FIG. 1A. More particularly, FIG. 8A is a cutaway view of the razor head cleaning nozzle 12 and the bottom of the fluid supply apparatus 14 viewed from direction A in FIG. 1A. Disposed within void 33 of the neck support structure 30 is neck 32. Note that in alternative embodiments, void 33 may not be present within the neck support structure 30, in which case, the neck 32 and the neck support structure 30 may be merged together. In still other embodiments, neck support structure 30 may not be present in some cases where, for example, neck 32 is made from a material with substantial structure strength such as metal.

Within neck 32 is conduit 36 that provides a channel for a cleaning fluid to flow from the connector 20 to the nozzle head 80. The neck 32 extending from the connector 20 to the nozzle head 80 (or nozzle head support structure 50). Depending on how the neck 32 is defined, in some embodiments, the neck 32 may be connected to the nozzle head 80 via the neck support structure 30 (e.g., the neck 32 is in fluid communication with the nozzle head 80 via the neck support structure 30). In alternative embodiments, however, the neck 32 may be directly connected to the nozzle head 80.

The conduit 36 may have a portion 38 that is more constricted with a smaller cross-sectional area than the cross-sectional areas of other portions of the conduit 36. By having such a constriction, the cleaning fluid that flows to the nozzle head 80 from the fluid supply apparatus 14 may be provided to the nozzle head 80 at relatively high pressure. Further the combination of the cleaning fluid arriving at the nozzle head 80 at relatively high pressure and the small cross-sectional areas of the orifices 84 may ensure that the spray of cleaning fluid dispensed by orifices 84 will have sufficient force to remove foreign matter from a razor head 64.

Disposed below the nozzle head 80 is the razor head retainer 82 and skirt 40. In addition to channeling effluent, in some embodiments, the interior of the skirt 40 may be an extension of the walls of the conduit 36 that channels the flow of incoming cleaning fluid to the nozzle head 80 concentrating the flow to the interior of the perimeter of the nozzle head 80, which in some embodiments, may mirror the interior perimeter of any one or more commercially available razor heads of multibladed razor devices. In various embodiments, the nozzle head 80 may extend across and cover an entire bottom cross section of the conduit 36 that is nearest to the nozzle head 80. The skirt 40 may at least partially define a cavity through which cleaning fluid effluent that flowed through a razor head 64 during a cleaning operation is directed downwards to reduce lateral splattering of the cleaning fluid effluent.

Figure 8B:
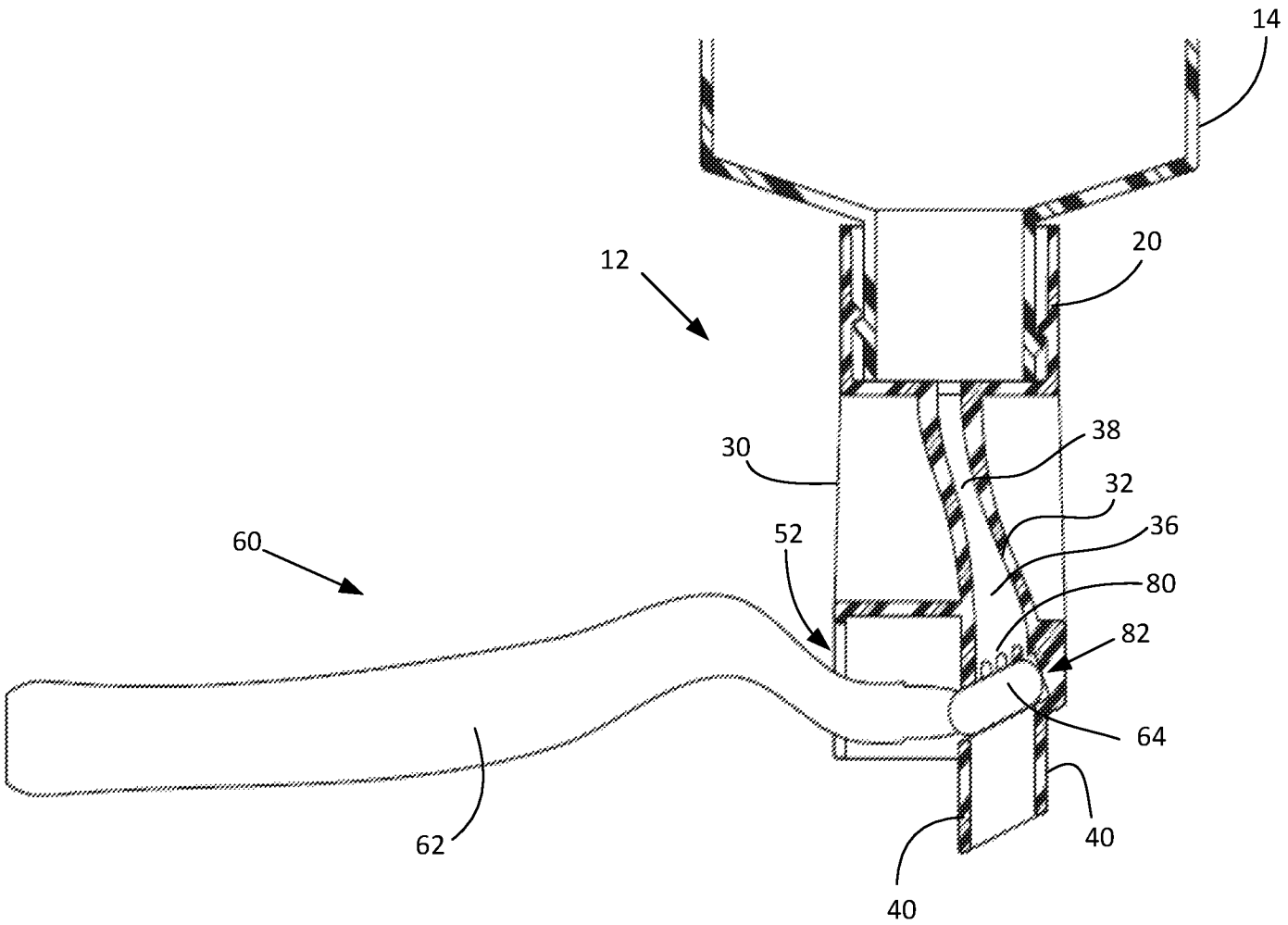
FIG. 8B is a cutaway sideview of the razor head cleaning nozzle illustrated in FIG. 1A when a razor head has been inserted into the razor head cleaning nozzle.

FIG. 8B is a cutaway sideview of the razor head cleaning nozzle 12 of FIG. 8A when a razor head 64 of a multibladed razor device 60 has been inserted into the razor head cleaning nozzle 12. When the fluid supply apparatus 14, which in this case is a plastic bottle, is squeezed, cleaning fluid is forced through the connector 20 and into the conduit 36. Because of the constricted portion 38 of the conduit 36, the cleaning fluid that flows into the orifices 84 of the nozzle head 80 will be pressurized. As a result, the clean fluid sprayed by the orifices 84 (with relative small cross-sectional areas) to the blades 66* of the razor head 64 will contact the blades 66* with sufficient force to dislodge foreign matter stuck between the blades 66* and behind the stiffeners 70. Due to the presence of skirt 40, cleaning fluid effluent that discharges from the razor head 64 will be directed downwards with minimal lateral spraying.

FIG. 9 is a perspective view of a razor head cleaning nozzle with an interchangeable spray head attachment in accordance with various embodiments. The razor head cleaning nozzle 90 includes a connector-neck component 92 that may be attached to an interchangeable spray head attachment 94. The connector-neck component 92 may include a connector 120 connected to a neck support structure 130, which includes a neck 132. The connector 120, the neck support structure 130, and the neck 132 mirror the connector 20, the neck support structure 30, and the neck 32 previously described.

In various embodiments, the interchangeable spray head attachment 94 includes a nozzle head support structure 150, a nozzle head 180, a razor head retainer (not shown), and skirt 140 that mirror the nozzle head support structure 150, the nozzle head 80, razor head retainer 82, and skirt 40 previously described. In various embodiments, the interchangeable spray head attachment 94 may be attached to the connector-neck component 92 using a variety of attachment means including, for example, employing slots or grooves that permit the interchangeable spray head attachment 94 to slide into the slot or groves of the connector-neck component 92.

In various embodiments, an interchangeable spray head attachment 94 may be designed to receive and clean the razor head of a specific multibladed razor device model. That is the spray orifices of the nozzle head 180 of the interchangeable spray head attachment 94 may be arranged specifically to clean the razor head of a particular multi-bladed razor device with specific number of razors and razor arrangement. Similarly, the razor head retainer of the interchangeable spray head attachment 94 may be configured to only receive a specific model of razor head with a particular configuration. Thus, each interchangeable spay head attachment 94 may be configured for use with specific models of razor heads with a specific configuration.

For example, suppose a user uses a particular brand of multi-bladed razor device with a three-bladed razor head for his shaving needs, then the user may employ with the razor head cleaning nozzle 90 a first interchangeable spray head attachment 94 that is configured to receive and clean the three-bladed razor head of the particular multi-bladed razor device. The user then decides to start using a different multi-bladed razor device that has a five-bladed razor head. Under such circumstances, the user would simply switch out the first interchangeable spray head attachment 94 with a second interchangeable spray head attachment 94 that is specifically configured to receive and clean the razor head of the new multi-bladed razor device.

In the following, various dimensions of an example implementation of a razor head cleaning system will be provided. The dimensions to be provided are example dimensions of an example implementation of a razor head cleaning system and that are provided for illustrative purposes only and are not intended to be limiting.

Referring to FIG. 3A, height $H_1$ of razor head cleaning system 10 in one embodiment is about 252.5 millimeter (mm). For this particular embodiment, height $H_2$ is about 16.0 mm, height $H_3$ is about 21.3 mm, and $H_4$ is about 14.0. For this embodiment, the width $W_1$ of the nozzle head support structure 50 is about 44.8 mm Turning to FIG. 3B, and in the same embodiment, width $W_2$ of the fluid supply apparatus 14 is about 62.5 mm, the width $W_3$ of the skirt 40 is about 37.5 mm, and the height $H_5$ is about 10.3 mm.

In FIG. 5, width $W_4$, which is the width of the conduit opening 22, is about 17.3 mm, the width $W_5$, which is the width of connector 20, is about 27.34 mm, the depth $D_1$, which is the depth of nozzle head support structure 50, is about 29.0 mm, and depth $D_2$, which is the depth of the conduit opening 22, is about 2.0 mm (in other embodiments, the depth of the conduit opening 22 may be about 5.0 mm, about 3 mm, or about 2.5 mm). In FIG. 6, width $W_6$ is about 44.8 mm, width $W_7$, which is the width of opening 81, is about 34.5 mm, and depth $D_3$, which is the depth of opening 81, is about 8.1 mm. In FIG. 8A, angle $A_1$ may be about 22.5 degrees.

The various embodiments described herein, have been presented as non-limiting example embodiments of the present disclosure, unless otherwise expressly indicated. After reviewing the present disclosure, an individual of ordinary skill in the art will immediately appreciate that some details and features can be added, removed and/or changed without deviating from the spirit of the disclosure. Reference throughout this specification to "various embodiments," "one embodiment," "an embodiment," "additional embodiment(s)", "alternative embodiments," or "some embodiments," means that a particular feature, structure or characteristic described in connection with the embodiment (s) is included in at least one or some embodiment(s), but not necessarily all embodiments, such that the references do not necessarily refer to the same embodiment (s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled. Accordingly, the claims are not limited by the disclosure.

What is claimed is:

1. A razor head cleaning system, comprising:

a fluid supply apparatus;

a nozzle head that includes a plurality of spray orifices arranged in parallel rows;

a neck having a first end and a second end, the neck connected at the first end via a connector to the fluid supply apparatus and connected at the second end to one side of the nozzle head, the neck includes a conduit extending from the first end to the second end for channeling cleaning fluid from the fluid supply apparatus to the plurality of spray orifices;

a razor head retainer disposed adjacent to a side of the nozzle head that is opposite from the side of the nozzle head connected to the neck and having one or more slots for receiving and holding one or more portions of a multibladed razor head; and at least one skirt that is disposed adjacent to a side of the razor head retainer that is opposite from a side of the razor head retainer that is adjacent to the nozzle head, the at least one skirt at least partially defining a cavity through which cleaning fluid that flows through the multibladed razor head is directed downwards away from the razor head retainer.

2. The razor head cleaning system of claim 1, wherein the fluid supply apparatus is a squeezable bottle.

3. The razor head cleaning system of claim 2, wherein the squeezable bottle is a plastic water bottle.

4. The razor head cleaning system of claim 1, wherein the connector at the first end of the neck is a female connector and the fluid supply apparatus includes a male connector to couple with the female connector.

5. The razor head cleaning system of claim 1, wherein a portion of the conduit that extends between the first end and the second end of the neck being constricted at one portion of the conduit relative to other portions of the conduit such that the cross-sectional area of the constricted portion is smaller than cross-sectional areas of the other portions of the conduit.

6. The razor head cleaning system of claim 1, wherein at least some of the spray orifices of the nozzle head are longitudinally angled relative to the blades of the multibladed razor head such that cleaning fluids that are sprayed from these spray orifices and directed to the multibladed razor head will be sprayed angled in longitudinal directions relative to the blades of the multibladed razor head.

* * * * *